US008007422B2

(12) United States Patent
Zaccherini

(10) Patent No.: US 8,007,422 B2
(45) Date of Patent: Aug. 30, 2011

(54) DEVICE FOR AN EXERCISE MACHINE

(75) Inventor: Leo Zaccherini, Riolo Terme (IT)

(73) Assignee: Technogym S.p.A., Gambettola (IT)

( * ) Notice: Subject to any disclaimer, the term of this patent is extended or adjusted under 35 U.S.C. 154(b) by 0 days.

(21) Appl. No.: 12/575,332

(22) Filed: Oct. 7, 2009

(65) Prior Publication Data

US 2010/0087298 A1 Apr. 8, 2010

(30) Foreign Application Priority Data

Oct. 8, 2008 (IT) ..... BO2008A0618

(51) Int. Cl.
*A63B 71/00* (2006.01)
*A63B 22/14* (2006.01)
*A63B 21/00* (2006.01)

(52) U.S. Cl. ..... 482/139; 482/146; 482/137

(58) Field of Classification Search ..... 482/52–54, 482/57, 70, 92, 114–119, 139, 901, 44–46; 601/5, 27, 46–49, 84, 94, 101–102
See application file for complete search history.

(56) References Cited

U.S. PATENT DOCUMENTS

| | | | | |
|---|---|---|---|---|
| 2,271,382 | A * | 1/1942 | Worthington | 601/61 |
| 2,845,063 | A * | 7/1958 | Allen | 601/26 |
| 3,713,438 | A * | 1/1973 | Knutsen | 601/35 |
| 4,570,927 | A * | 2/1986 | Petrofsky et al. | 482/60 |
| 4,936,292 | A * | 6/1990 | Hidetsugu | 601/104 |
| 5,630,790 | A * | 5/1997 | Ito | 601/94 |
| 5,716,331 | A * | 2/1998 | Chang | 601/50 |
| 5,792,079 | A * | 8/1998 | Hatfield | 601/49 |
| 5,857,986 | A * | 1/1999 | Moriyasu | 601/49 |
| 6,106,491 | A * | 8/2000 | Gianutsos | 601/104 |
| 6,511,404 | B2 * | 1/2003 | Tu | 482/57 |
| 6,908,416 | B2 * | 6/2005 | Mercado et al. | 482/52 |
| 7,166,067 | B2 * | 1/2007 | Talish et al. | 482/148 |
| 7,322,948 | B2 * | 1/2008 | Talish et al. | 601/49 |
| 7,402,145 | B1 * | 7/2008 | Woggon et al. | 601/49 |
| 7,530,927 | B2 * | 5/2009 | Chuang | 482/53 |
| 7,594,878 | B1 * | 9/2009 | Joannou | 482/54 |
| 7,771,327 | B1 * | 8/2010 | Reams | 482/80 |
| 2002/0183666 | A1 * | 12/2002 | Suh | 601/84 |
| 2003/0073550 | A1 * | 4/2003 | Hsu | 482/142 |
| 2003/0130602 | A1 * | 7/2003 | Chang | 601/49 |
| 2004/0067833 | A1 * | 4/2004 | Talish et al. | 482/148 |

(Continued)

FOREIGN PATENT DOCUMENTS

DE 200 10 140 U1 9/2000

(Continued)

*Primary Examiner* — Rinaldi Rada
*Assistant Examiner* — Robert Long
(74) *Attorney, Agent, or Firm* — Pearne & Gordon LLP

(57) ABSTRACT

A device for an exercise machine comprising a base, forming at least one substantially flat supporting surface, at least one resistant load connected to the base, at least one seat for a user, being positioned in front of the supporting surface, connected to the base in such a way that it can move from a forward position to a back position relative to the supporting surface, the seat being connected to the resistant load for performing an exercise; the device being characterized in that it comprises at least one footplate which can be selectively connected to the base at the supporting surface by removable supporting means, at least one actuator portion connected to the supporting means being designated to generate a vibration for the footplate.

20 Claims, 2 Drawing Sheets

U.S. PATENT DOCUMENTS

| | | | | |
|---|---|---|---|---|
| 2004/0127822 | A1* | 7/2004 | Eisenberg | 601/49 |
| 2005/0165332 | A1* | 7/2005 | Talish et al. | 601/23 |
| 2006/0229170 | A1* | 10/2006 | Ozawa et al. | 482/92 |
| 2006/0252610 | A1* | 11/2006 | Wilson | 482/92 |
| 2007/0123390 | A1* | 5/2007 | Mathis | 482/8 |
| 2007/0259757 | A1* | 11/2007 | Chen | 482/53 |
| 2008/0032866 | A1* | 2/2008 | Chang | 482/51 |
| 2008/0090710 | A1* | 4/2008 | Chung | 482/142 |
| 2008/0167589 | A1* | 7/2008 | Fung | 601/104 |
| 2008/0171639 | A1* | 7/2008 | Hahn | 482/52 |
| 2008/0255477 | A1* | 10/2008 | Woggon et al. | 600/595 |
| 2010/0049105 | A1* | 2/2010 | Joannou | 601/49 |
| 2010/0105524 | A1* | 4/2010 | Laurent | 482/4 |

FOREIGN PATENT DOCUMENTS

| | | | |
|---|---|---|---|
| SU | 1 584 965 | A1 | 8/1990 |
| WO | 2006/070429 | A1 | 7/2006 |

* cited by examiner

DEVICE FOR AN EXERCISE MACHINE

BACKGROUND OF THE INVENTION

This invention relates to a device for an exercise machine for performing an exercise. In particular, this invention relates to a device to be connected to an exercise machine for performing an exercise for leg muscle strength training using a resistant load with vibration.

There are prior art exercise machine for developing leg muscle strength, called "leg-presses", of the type comprising a base, a resistant load usually consisting of a weight stack able to move relative to the base along vertical guides, a footplate which is fixed relative to the base and a seat connected to the resistant load by a flexible cable and free to slide on substantially horizontal guides. While performing the leg muscle strength training exercise, the user, with his feet resting on the footplate, alternately extends and bends his legs, in this way moving the seat backwards and forwards and cyclically lifting the resistant load. Obviously, the same result may be achieved by inverting the constraints in the exercise machine, that is to say, making the seat fixed to the base and the footplate able to move in a substantially horizontal direction and connected to the resistant load.

The application of vibrations to exercise machines to develop muscular strength has been known for some time now. In particular, there are prior art "leg-press" type exercise machines in which a device for generating vibrations in incorporated in the footplate so that it makes the footplate vibrate. Such devices are made, for example, using an eccentric mass which is driven to rotate by an electric motor.

The prior art devices have many disadvantages.

First, they are particularly bulky and heavy, meaning that the exercise machine dimensions are too big and it is difficult to move, compared, for example, with an exercise machine which is not fitted with a vibration generating device. It must be emphasized that the dimensions and ease of handling of an exercise machine are amongst the most important features for a gym, where the space available is almost always limited and therefore the best possible use must be made of it. Moreover, in gyms pieces of equipment often have to be moved for cleaning, maintenance or other reasons.

Moreover, the prior art devices cannot be removed from the exercise machine by operations which are simple and in any case return the machine to its basic configuration, i.e.: that of a machine having a gravitational resistant load without vibration. From this viewpoint, the prior art devices do not allow the exercise machine to be flexible and to be able to easily pass from a configuration with vibration to one without it.

SUMMARY OF THE INVENTION

This invention therefore has for a technical purpose to overcome the above-mentioned disadvantages by providing a device with reduced weight and dimensions and such that it can be suitably integrated with the exercise machine, maintaining the dimensions and ease of handling of a similar machine without a vibration generating device.

Within said technical purpose, this invention has for an aim to provide a device which is mounted on the exercise machine with simple, rapid operations.

Another aim of this invention is to provide a device for exercise machines which has a simple structure, is easy to make in practice, operates safely and effectively and is relatively inexpensive.

Said purpose and aims are all achieved by this device for an exercise machine comprising a base, forming at least one substantially flat supporting surface, at least one resistant load connected to the base, at least one seat for a user, being positioned in front of the supporting surface, connected to the base in such a way that it can move from a forward position to a back position relative to the supporting surface, the seat being connected to the resistant load for performing an exercise; the device being characterized in that it comprises at least one footplate which can be selectively connected to the base at the supporting surface by removable supporting means, at least one actuator portion connected to the supporting means being designed to generate a vibration for the footplate.

BRIEF DESCRIPTION OF THE DRAWINGS

The technical features of the invention, with reference to the above aims, are clearly described in the claims below, and its advantages are more apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
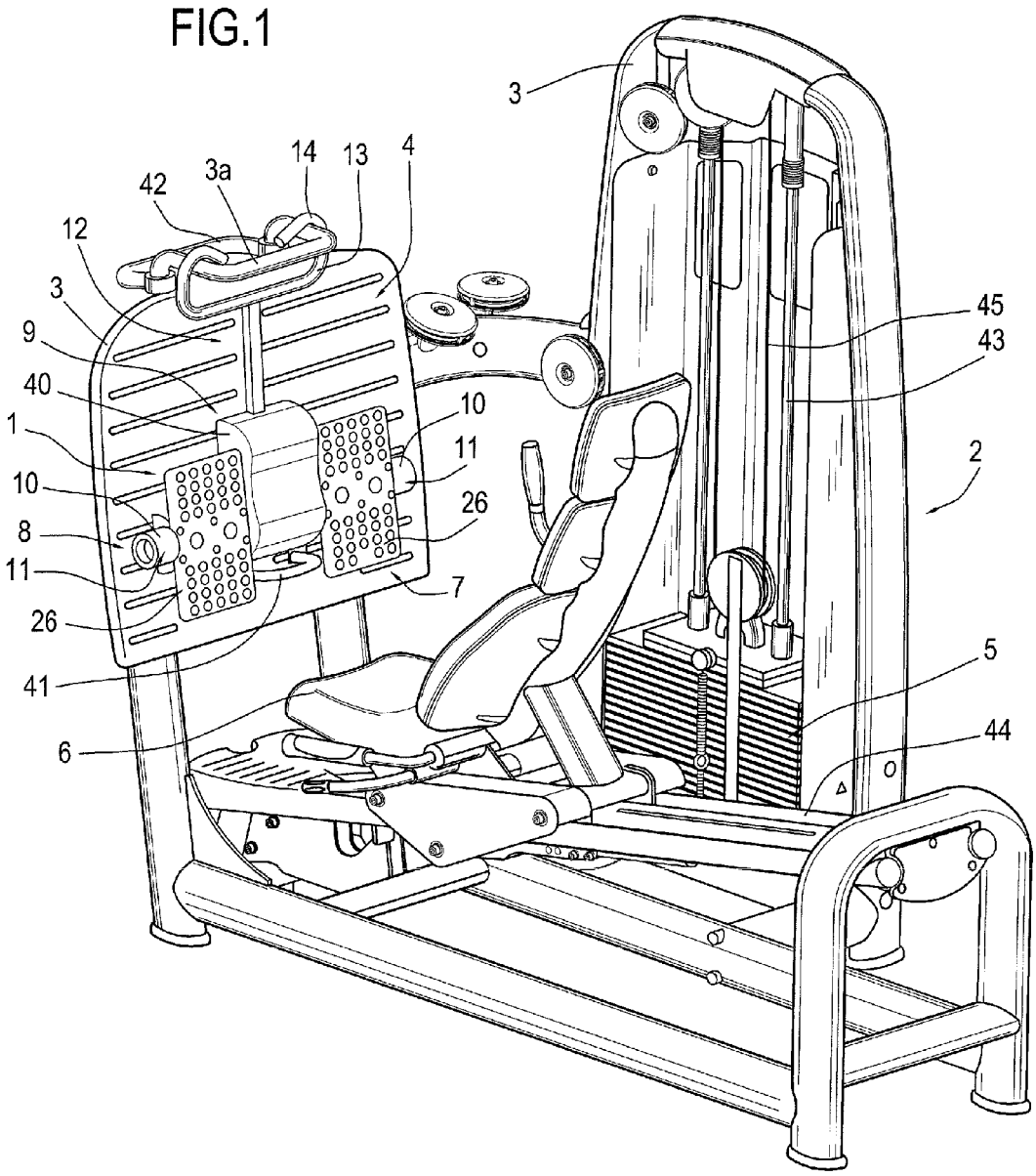
FIG. 1 is a perspective view of an exercise machine with the device made in accordance with this invention.
Figure 2:
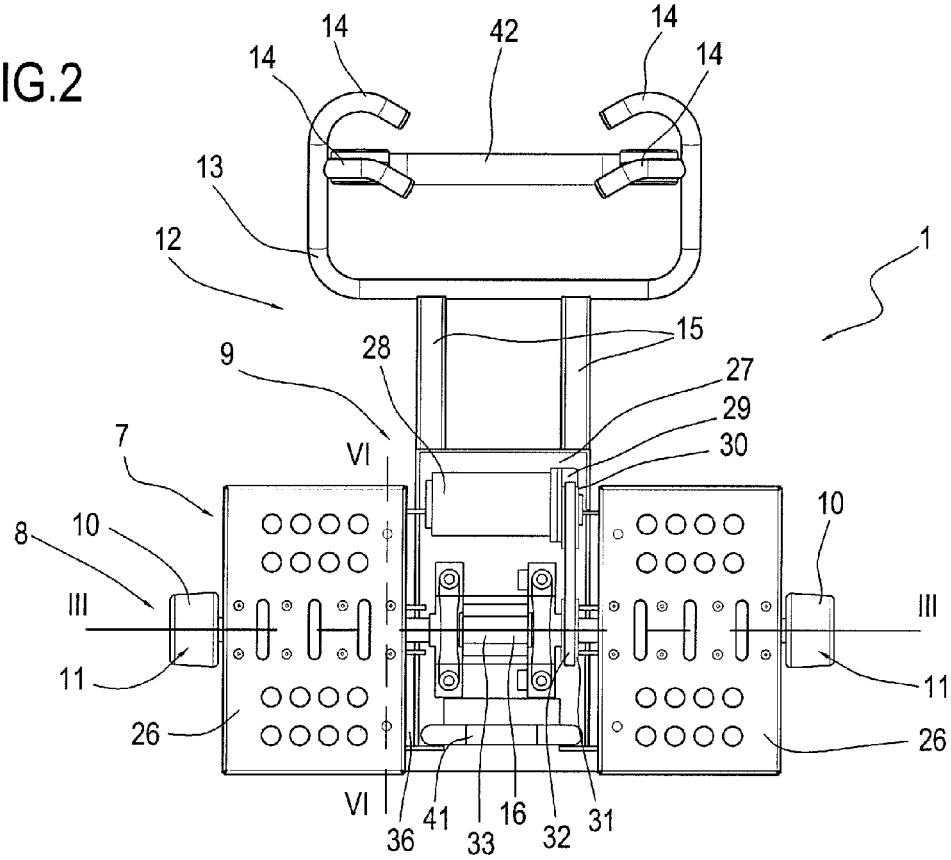
FIG. 2 is a plan view of the device in accordance with the invention.

With reference to the accompanying drawings, and in particular with reference to FIGS. 1 and 2, the numeral 1 denotes a device in accordance with the invention for an exercise machine 2 which can be used to perform exercises for developing leg muscle strength.

The exercise machine 2 comprises a base 3 forming at least one substantially flat supporting surface 4 and at least one resistant load 5 connected to the base 3. Moreover, the machine 2 comprises at least one seat 6 for a user, positioned in front of the supporting surface 4 and connected to the base 3 in such a way that it can move from a forward position to a back position relative to the supporting surface 4. The seat 6 is connected to the resistant load 5 for performing a muscle training exercise.

The base 3 comprises a welded metal structure of the conventional, known type and is not described in detail.

The device according to the invention advantageously comprises at least one footplate 7 which can be selectively connected to the base 3 at the supporting surface 4 by supporting means 8 described in more detail below. Moreover, advantageously, the device comprises at least one actuator portion 9 connected to the supporting means 8 and designed to generate a vibration for the footplate 7.

Advantageously, the supporting means 8 are removable, meaning that the device 1 can be selectively connected to the exercise machine according to user requirements and the type of exercise to be performed.

The supporting means 8 suitably comprise at least one base element 10 designed to make contact on the supporting surface 4 to support the footplate 7 in such a way that it is raised and free to vibrate relative to the supporting surface while the exercise with vibration is performed.

In particular, even more advantageously, the supporting means 8 comprise two base elements 10 positioned at the lateral ends of the device.

Appropriately, each base element 10 has a substantially cylindrical shape, the outer lateral surface 11 being designed to make contact on the supporting surface 4 joining along a generatrix. Moreover, each base element 10 is connected to the footplate 7 in such a way that it can rotate freely.

The supporting means 8 advantageously comprise at least one hooking element 12 for coupling the device to the base 3 while the exercise with vibration is performed. The hooking element 12 has an upper end 13 coupled to a U-shaped substantially cylindrical bar 3*a* rigidly supported by the base 3 above the supporting surface 4, by at least one hook 14 and a lower end 15 connected to the footplate 7.

In more detail, the hooking element 12 is coupled to the base 3 close to the ends of the bar 3*a* by respective hooks 14. As shown in FIG. 2, the hooking element 12 suitably comprises a plurality of hooks 14 designed to be coupled to the bar 3*a* in such a way as to allow selective connection of the footplate 7 to the supporting surface 4 at different heights according to the anthropometric characteristics of the user.

Figure 3:
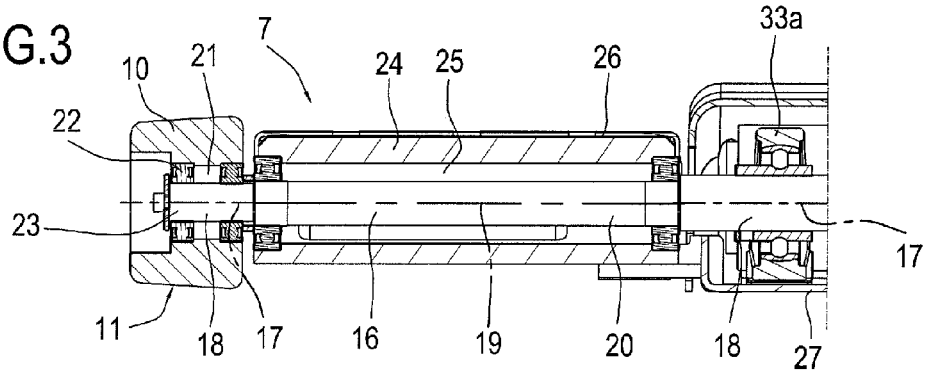
FIG. 3 is a side elevation view of a cross-section of a part of the device according to the plane III-III of FIG. 2.

With reference to FIG. 3, which shows a cross-section of a part of the device according to the invention, it can be seen how the device 1 advantageously comprises at least one shaft 16 coupled in such a way that it can rotate freely to each of the base elements base 10 on a first axis 17, at a first portion 18 of the shaft 16. The footplate 7 is connected in such a way that it can rotate freely to the shaft 16 on a second, eccentric axis 19 at a second portion 20 of the shaft 16. The actuator portion 9 is designed to make the shaft 16 rotate about the first axis 17 in such a way that a vibration is generated for the footplate 7.

Appropriately, each of the two base elements 10 has a substantially cylindrical shape and an axial hole 21 which is coaxial with the first axis 17, for coupling to the shaft 16 on said first axis 17 by means of respective radial bearings 22, at the respective end portions 23 of the shaft 16.

In more detail, the footplate 7 is advantageously connected to the shaft 16 by at least one supporting element 24 rigidly coupled below the footplate 7. In turn, the supporting element 24 is coupled in such a way that it can rotate freely to the shaft 16 on the second axis 19 at an axial through-cavity 25 designed to house the second portion 20 of the shaft 16.

Advantageously, the footplate 7 comprises two rectangular plates 26, one for each of the user's feet, coupled in such a way that they can rotate freely to the shaft 16 on the second axis 19 by respective supporting elements 24.

As FIG. 2 shows, the actuator portion 9 comprises at least one frame 27 to which at least a motor 28 is rigidly coupled by means of a fixing bracket 29. A driving pulley 30 is fitted on the motor 28 shaft, whilst a driven pulley 31 fitted on the shaft 16 on the first axis 17 is connected to the driving pulley 30 by a drive belt 32. The driving pulley 30, driven by the motor 28, therefore transmits a rotating motion to the shaft 16.

Advantageously, the frame 27 is rigidly connected to the lower end 15 of the hooking element 12.

The shaft 16 is coupled, at a central portion 33, in such a way that it can rotate freely to the shaft 27 on the first axis 17 by means of bearings 33*a*.

The actuator portion 9 is suitably positioned between the rectangular plates 26 and each of the plates 26 is positioned adjacent to the respective end portion 23 of the shaft 16.

Figure 4:
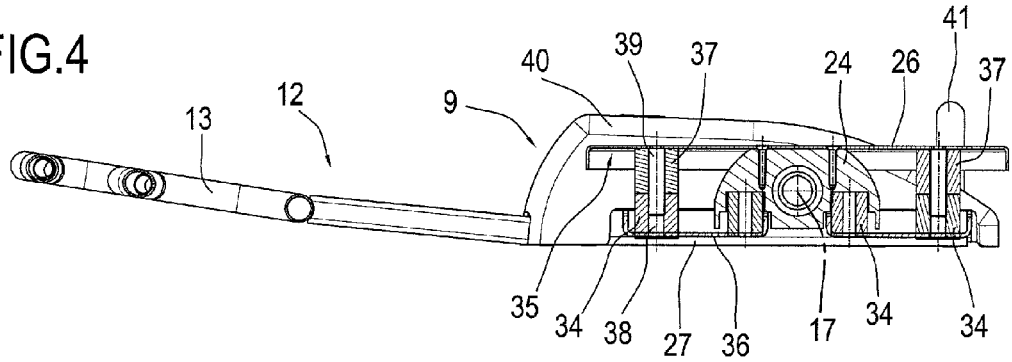
FIG. 4 is a side elevation view of the device partly in cross-section according to the plane IV-IV of FIG. 2.

With reference to FIG. 4, each of the plates 26 of the footplate 7 is advantageously connected to the frame 27 by at least one respective elastic element 34 inserted between the lower face 35 of the footplate 7 and at least one sheet 36 consisting of a lateral extension of the frame 27 below the footplate 7.

In more detail, each of the plates 26 is connected to the frame 27 by at least two respective elastic elements 34 consisting of cylinders 37 with respective axial cavities 38 for coupling to respective pins 39 rigidly supported by the lower face 35 of the plate 26, on opposite sides relative to the first axis 17. Each cylinder 37 may be made of rubber and be inserted pre-loaded between the lower face 35 of each plate 26 and the sheet 36, thus preventing any contact between the plates 26 and other parts of the device and in such a way that the rest of the device is isolated from the vibrations transmitted by the footplate 7.

Advantageously, the actuator portion 14 comprises an upper cover 40 designed to protect the user from any contact with moving parts. The upper cover 40 is not illustrated in FIG. 2 so that parts of the device 1 which would otherwise be hidden are visible.

Advantageously, the device 1 according to the invention comprises a handle 41, fixed to the frame 27 in a position opposite the hooking element 12, designed to be gripped by a user for easily lifting the device and rapidly unhooking it from the bar 3*a*.

Moreover, the device 1 comprises a U-shaped substantially cylindrical rod 42, designed to be rigidly connected to the base 3 of the exercise machine 2 above the supporting surface 4 on the opposite side relative to the seat 6, thus acting as a support for the device 1 when it is not in use.

In the example in FIG. 1, the device is applied to an exercise machine commonly known as a "leg-press" in which the resistant load 5 is of the weight stack type and is connected to the base 3 in such a way that it can slide freely on substantially vertical guides 43. The seat 6 is supported by the base 3 in such a way that it can move on substantially horizontal guides 44 and is connected to the resistant load 5 by at least one flexible cable 45, only partly illustrated in FIG. 1, for performing an exercise. Obviously, the device may be applied to different types of exercise machines, having at least one supporting surface on which the user can interact using the device.

Operation of the device 1 in accordance with the invention is intuitive and is described below.

When an exercise is performed with vibration, the device is connected to the base 3 of the exercise machine at the supporting surface 4 by supporting means 8. In particular, the hooking element 12 is coupled to the bar 3*a* by a predetermined hook 14 corresponding to the ideal height of the footplate 7 according to the user's anthropometric characteristics. Moreover, the footplate 7 is connected to the supporting surface 4 by the base elements 10, which are coupled to the shaft 16. Once the shaft 16 is made to rotate on the first axis 17 by the motor 28, at the second portion of the shaft a vibration is generated due to the eccentricity of the second axis 19 which is transmitted to each rectangular plate 26 of the footplate 7 through the respective supporting elements 24.

At this point, the user, with his feet resting on the footplate 7, can perform leg muscle strength training by alternately extending and bending his legs, consequently moving the seat 6 backwards and forwards and cyclically lifting the resistant load 5. In the case of the example in FIG. 1, the resistant load 5 is subject to gravity, and therefore constant, however, due to the footplate 7 vibration while exercising the user perceives and is subjected to a resistant load with vibration. It must be added that the extent of the frequency of the vibration may be varied by simply modifying the speed of rotation of the shaft 16, whilst the amplitude of the vibration depends on the eccentricity value of the second portion 20 of the shaft 16.

At the end of the exercise, the device 1 can be removed from the exercise machine 2 simply and rapidly and easily hooked to the supporting rod 42, behind the supporting surface 4.

Moreover, once the device has been removed, the machine is immediately in the basic configuration, that is to say, having a resistant load which is subject to gravity but without vibration. Therefore, it is possible to switch to the "conventional" training method without having to plan and implement changes to the machine.

Therefore, as indicated the invention achieves the preset aims.

The device for an exercise machine according to the invention is simple to produce, with reduced weight and dimensions and such that it can be suitably integrated with the exercise machine, maintaining the dimensions and ease of handling of a similar machine without a vibration generating device.

Moreover, the operations for mounting the device on the exercise machine are simple and rapid, without requiring modifications to the machine.

The invention described above is susceptible of industrial application and may be modified and adapted in several ways without thereby departing from the scope of the inventive concept. Moreover, all details of the invention may be substituted by technically equivalent elements.

What is claimed is:

1. A device for an exercise machine comprising a base (3), forming at least one substantially flat supporting surface (4), at least one resistant load (5) connected to the base (3), at least one seat (6) for a user, being positioned in front of the supporting surface (4), connected to the base (3) in such a way that it can move from a forward position to a back position relative to the supporting surface (4), the seat being connected to the resistant load (5) for performing an exercise; wherein the device comprises at least one footplate (7) which can be selectively connected to the base (3) at the supporting surface (4) by removable supporting means (8), at least one actuator portion (9) connected to the supporting means (8) being designed to generate a vibration for the footplate (7), the supporting means (8) comprising at least one base element (10) designed to support the footplate (7) in such a way that it is raised and free to vibrate relative to the supporting surface (4) while the exercise is performed, the actuator portion (9) being coupled to a shaft (16) to drive the shaft (16) in rotation around a first axis (17), the shaft (16) having an eccentric portion (20) defining a second, eccentric axis (19), parallel to the first axis (17) and arranged at a predetermined distance thereto, the footplate (7) being rotatably connected to said eccentric portion (20), whereby a rotation of the shaft (16) around the first axis (17) generates a rotation around the first axis (17) of the eccentric portion (20) of the shaft (16) and of the footplate (7) coupled thereto, thus generating a vibrating effect for a user having his feet pressed on the footplate (7).

2. The device according to claim 1, wherein the supporting means (8) comprise at least one hooking element (12) for coupling the device to the base (3) while the exercise with vibration is performed.

3. The device according to claim 2, wherein the hooking element (12) has an upper end (13) coupled to a U-shaped substantially cylindrical bar (3*a*) rigidly supported by the base (3) above the supporting surface (4), by at least one hook (14) and a lower end (15) connected to the footplate (7).

4. The device according to claim 3, wherein the hooking element (12) comprises a plurality of hooks (14) designed to be coupled to the bar (3*a*) in such a way as to selectively connect the footplate (7) to the supporting surface (4) at different heights according to the anthropometric characteristics of the user.

5. The device according to claim 2, comprising a handle (41) designed to be gripped by a user to lift the device and unhook it from the hooking element (12).

6. The device according to claim 1, wherein the supporting means (8) comprise two base elements (10) positioned at the lateral ends of the device and designed to make contact on the supporting surface (4) to support the footplate (7) in such a way that it is raised and free to vibrate relative to the supporting surface (4) while the exercise with vibration is performed.

7. The device according to claim 1, wherein each of the base elements (10) has a substantially cylindrical shape, the outer lateral surface (11) being designed to make contact on the supporting surface (4) tying said supporting surface along a generatrix; each of the base elements (10) being connected to the footplate (7) in such a way that they can rotate freely.

8. The device according to claim 1, wherein the supporting means (8) comprise at least two base elements (10), each having a substantially cylindrical shape and an axial hole (21) which is coaxial with the first axis (17), for coupling to the shaft (16) on said first axis (17) by means of respective radial bearings (22), at the respective end portions (23) of the shaft (16).

9. The device according to claim 1, wherein the footplate (7) is connected to a shaft (16) by at least one supporting element (24) which is rigidly coupled below the footplate (7); the supporting element (24) being coupled in such a way that it can rotate freely to the shaft (16) on a second axis (19) at an axial through-cavity (25) designed to house a second portion (20) of the shaft (16).

10. The device according to claim 1, wherein the footplate (7) comprises two rectangular plates (26) coupled in such a way that they can rotate freely to a shaft (16) on a second axis (19) by respective supporting elements (24).

11. The device according to claim 1, wherein the actuator portion (9) comprises at least one frame (27) to which at least one motor (28) is rigidly coupled by means of a fixing bracket (29), at least one driving pulley (30) fitted on the motor (28) shaft, at least one driven pulley (31) fitted on a shaft (16) on a first axis (17); the driving pulley (30) and the driven pulley (31) being connected to each other by a drive belt (32) so that a rotating motion is transmitted to the shaft (16).

12. The device according to claim 11, wherein the frame (27) is rigidly connected to a lower end (15) of a hooking element (12).

13. The device according to claim 1, wherein the shaft (16) is coupled in such a way that it can rotate freely to a frame (27) on the first axis (17) at a central portion (33) of the shaft (16), by means of bearings (33*a*).

14. The device according to claim 1, wherein the actuator portion (9) is positioned between rectangular plates (26), and wherein each of the rectangular plates (26) is positioned adjacent to a respective end portion (23) of a shaft (16).

15. The device according to claim 1, wherein the footplate (7) is connected to a frame (27) by at least one elastic element (34) inserted between a lower face (35) of the footplate (7) and at least one sheet (36) consisting of a lateral extension of the frame (27) below the footplate (7).

16. The device according to claim 1, wherein the footplate (7) is connected to a frame (27) by at least two elastic elements (34) consisting of respective cylinders (37) with respective axial cavities (38) for coupling to respective pins (39) rigidly supported by a lower face (35) of the footplate (7) on opposite sides relative to a first axis (17); each of the elastic elements (34) being inserted between the lower face (35) of the footplate (7) and at least one sheet (36) consisting of a lateral extension of the frame (27) below the footplate (7).

17. The device according to claim 1, wherein the actuator portion (9) comprises an upper cover (40) designed to protect the user from any contact with moving parts.

18. The device according to claim 1, comprising a U-shaped substantially cylindrical rod (42) designed to be rigidly connected to the base (3) of the exercise machine above the supporting surface (4) on an opposite side relative to the seat (6), thus acting as a support for the device when it is not in use.

19. The device according to claim 1, wherein it can be selectively connected to an exercise machine in which the resistant load (5) is connected to the base (3) in such a way that it can slide freely on substantially vertical guides (43) and the seat (6) is supported by the base (3) in such a way that it can move on substantially horizontal guides (44); the seat (6) being connected to the resistant load (5) by at least one flexible cable (45), for performing an exercise.

20. A device for an exercise machine comprising a base (3), forming at least one substantially flat supporting surface (4), at least one resistant load (5) connected to the base (3), at least one seat (6) for a user, being positioned in front of the supporting surface (4), connected to the base (3) in such a way that it can move from a forward position to a back position relative to the supporting surface (4), the seat being connected to the resistant load (5) for performing an exercise; wherein the device comprises at least one footplate (7) which can be selectively connected to the base (3) at the supporting surface (4) by removable supporting means (8), at least one actuator portion (9) connected to the supporting means (8) being designed to generate a vibration for the footplate (7), wherein the device can be selectively connected to an exercise machine in which the resistant load (5) is connected to the base (3) in such a way that it can slide freely on substantially vertical guides (43) and the seat (6) is supported by the base (3) in such a way that it can move on substantially horizontal guides (44); the seat (6) being connected to the resistant load (5) by at least one flexible cable (45), for performing an exercise.

* * * * *